US007413181B2

(12) United States Patent
Iida et al.

(10) Patent No.: US 7,413,181 B2
(45) Date of Patent: Aug. 19, 2008

(54) METHOD AND APPARATUS FOR IMAGE FORMING CAPABLE OF EFFECTIVELY PERFORMING SHEET FINISHING OPERATION

(75) Inventors: Junichi Iida, Kanagawa (JP); Junichi Tokita, Kanagawa (JP); Shingo Matsushita, Kanagawa (JP); Nobuyoshi Suzuki, Tokyo (JP); Kenji Yamada, Tokyo (JP); Hiromoto Saitoh, Kanagawa (JP); Naohiro Kikkawa, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 293 days.

(21) Appl. No.: 11/273,301

(22) Filed: Nov. 15, 2005

(65) Prior Publication Data

US 2006/0120784 A1 Jun. 8, 2006

(30) Foreign Application Priority Data

Nov. 15, 2004 (JP) ..... 2004-330033
Sep. 16, 2005 (JP) ..... 2005-269528

(51) Int. Cl.
*B65H 37/04* (2006.01)

(52) U.S. Cl. ..... 270/58.12; 270/37; 270/58.07; 270/58.08; 270/58.04; 270/58.02; 270/58.09; 270/58.17

(58) Field of Classification Search ..... 270/37, 270/58.02, 58.04, 58.07, 58.08, 58.09, 58.12, 270/58.17; 399/407
See application file for complete search history.

(56) References Cited

U.S. PATENT DOCUMENTS 5,263,697 A 11/1993 Yamazaki et al.
5,508,798 A 4/1996 Yamada
5,762,328 A 6/1998 Yamada et al.
6,145,825 A 11/2000 Kunihiro et al.
6,199,853 B1 3/2001 Andoh et al.
6,231,045 B1 5/2001 Yamada et al.
6,264,191 B1 7/2001 Suzuki et al.
6,296,247 B1 10/2001 Tamura et al.

(Continued)

FOREIGN PATENT DOCUMENTS

JP 2000-211795 8/2000

OTHER PUBLICATIONS

U.S. Appl. No. 11/273,301, filed Nov. 15, 2005, Iida et al.

*Primary Examiner*—Gene O. Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A sheet finishing apparatus includes a conveying member configured to convey recording media and a tray configured to receive the recording media conveyed by the conveying member. The tray includes a holding member configured to hold the recording media therein and to contact a first edge of the recording media such that the recording media is positioned, a rotatable moving member configured to contact the recording media such that the holding member abuts against the recording media, a discharging member configured to discharge the recording media stacked by the holding member, and a protruding member mounted on the discharging member and configured to contact a second edge of the recording media such that the recording media is positioned. One of the rotatable moving member and the protruding member positions the recording media stacked in the tray in a travel direction of the recording medium.

20 Claims, 13 Drawing Sheets

U.S. PATENT DOCUMENTS 6,322,070 B2 11/2001 Yamada et al.
6,343,785 B1 2/2002 Yamada et al.
6,394,448 B2 5/2002 Suzuki et al.
6,416,052 B2 7/2002 Yamada et al.
6,494,449 B2 12/2002 Tamura et al.
6,494,453 B1 12/2002 Yamada et al.
6,527,269 B2 3/2003 Yamada et al.
6,549,734 B2 4/2003 Yamada et al.
6,631,896 B2 10/2003 Yamada et al.
6,698,744 B2 3/2004 Yamada et al.
6,783,124 B2 8/2004 Tamura et al.
6,905,118 B2 * 6/2005 Yamada et al. ..... 270/8
6,921,069 B2 * 7/2005 Suzuki et al. ..... 271/207
6,957,810 B2 10/2005 Yamada et al.
6,986,511 B2 1/2006 Yamada et al.
6,988,729 B2 1/2006 Tamura et al.
2002/0135119 A1 9/2002 Suzuki et al.
2003/0151187 A1 * 8/2003 Suzuki et al. ..... 270/1.01
2003/0160376 A1 * 8/2003 Yamada et al. ..... 270/58.07
2003/0215275 A1 11/2003 Tamura et al.
2003/0219295 A1 * 11/2003 Saitoh et al. ..... 399/410
2004/0104525 A1 6/2004 Suzuki et al.
2004/0254054 A1 12/2004 Suzuki et al.
2004/0256783 A1 12/2004 Iida et al.
2005/0061131 A1 3/2005 Tamura et al.
2005/0067777 A1 3/2005 Iida et al.
2005/0082747 A1 4/2005 Tamura et al.
2005/0206071 A1 9/2005 Suzuki et al.
2005/0211035 A1 9/2005 Tamura et al.
2005/0225021 A1 10/2005 Yamada et al.
2005/0277537 A1 12/2005 Matsushita

* cited by examiner

| FIG. 6A |
| --- |
| FIG. 6B |

| |
|---|
| FIG. 10A |
| FIG. 10B |
| FIG. 10C |

METHOD AND APPARATUS FOR IMAGE FORMING CAPABLE OF EFFECTIVELY PERFORMING SHEET FINISHING OPERATION

CROSS REFERENCE TO RELATED APPLICATIONS

The present application claims priority to Japanese patent application no. 2004-330033, filed in the Japan Patent Office on Nov. 15, 2004, and Japanese patent application no. 2005-269528, filed in the Japan Patent Office on Sep. 16, 2005, the disclosures of which are incorporated by reference herein in their entirety.

BACKGROUND OF THE INVENTION

1. Field of the Invention

The present invention relates to an image forming apparatus such as a copier, printer, facsimile machine and the like, more specifically, relates to a method and apparatus for image forming capable of effectively performing a predetermined sheet finishing operation.

2. Discussion of the Background

Conventionally, when an image forming apparatus such as a copier, printer, facsimile machine and the like completes production of a copy image, a sheet finishing apparatus attached to the image forming apparatus then performs a sheet finishing operation. In the sheet finishing operation, every time a recording medium having the copy image thereon is discharged to a tray for positioning and/or stapling, a rotatable elastic member disposed in a vicinity of the tray contacts the recording medium to abut the recording medium against a stopper so that the recording medium is positioned in a travel direction thereof.

A certain period of time is required to perform the stapling operation between jobs, which prevents an increase in productivity. To improve productivity, a mechanism has been provided in which a plurality of recording media or recording sheets is stored in a sheet conveying path and is conveyed at a time to a staple tray that performs a sheet stapling operation, which reduces a period of time for the stapling operation and improves productivity.

An example of background sheet finishing apparatus having the above-described mechanism that discharges the plurality of recording sheets to the staple tray includes a rotatable moving member (hereinafter, referred to as a "knock roller") and a protruding member (hereinafter, referred to as a "hook") mounted on a discharge belt to discharge a stack of the plurality of recording sheets to an external tray, so that the stack of the plurality of recording sheets can be positioned.

When contacting the stack of the plurality of recording sheets, the knock roller actually contacts with a last sheet that is placed on the top of the stack of the plurality of recording sheets. The plurality of recording sheets other then the last sheet accept a force to abut the plurality of recording sheets against the stopper through friction caused between the plurality of recording sheets, thereby reducing the force. When a single recording sheet is stacked, the hook is moved in a direction opposite to a sheet discharging direction, and the knock roller contacts the edge of the recording sheet, thereby stably performing a positioning operation. When a plurality of recording sheets is stacked, the knock roller contacts the edge of the recording sheets in a travel direction of the recording sheets. The knock roller, however, cannot stably position the plurality of recording sheets. That is, it is difficult to surely perform a positioning operation.

As described above, when the knock roller and the hook perform the positioning operation, the hook is used after the knock roller contacts with the stack of recording sheets, and the plurality of recording sheets fall to a staple tray.

At this time, the stack of recording sheets stays in the staple tray and is positioned with the recording sheets adhered to each other. In this case, a greater friction is caused between the recording sheets, resulting in failure such as insufficient positioning and folded sheets.

Further, when the knock roller and the hook are used for positioning, the hook contacts the edge of the recording sheet insufficiently while the knock roller is in motion. In this case, the force to necessary to abut the recording sheets against the stopper is not obtained, therefore, the knock roller and the hook cannot simultaneously contact the recording sheets. Therefore, when the knock roller and the hook are moved, certain periods of time for respective operations are needed, which makes it difficult to apply the operations for high speed processing.

SUMMARY OF THE INVENTION

The present invention has been made in view of the above-mentioned circumstances.

The present invention advantageously provides a novel sheet finishing apparatus that can surely position a plurality of recording sheets in stack and perform a high speed processing by improving operability of positioning.

The present invention further advantageously provides a novel method of positioning a stack of recording media.

The present invention also advantageously provides a novel image forming apparatus including the above-described novel sheet finishing apparatus.

In one embodiment, a novel sheet finishing apparatus includes a conveying member configured to convey recording media, and a tray configured to receive the recording media conveyed by the conveying member. The tray includes a holding member configured to hold the recording media therein and to contact a first edge of the recording media such that the recording media is positioned, a rotatable moving member configured to contact the recording media such that the holding member abuts against the recording media, a discharging member configured to discharge the recording media stacked by the holding member, and a protruding member mounted on the discharging member and configured to contact a second edge of the recording media such that the recording media is positioned. One of the rotatable moving member and the protruding member positions the recording media stacked in the tray in a travel direction of the recording medium.

The protruding member mounted on the discharging member can be moved in a direction opposite to the travel direction of the recording media and can contact the second edge of the recording media to abut the first edge of the recording media against the holding member such that the recording media is positioned in the travel direction of the recording media when the recording media having a plurality of sheets in a stack is conveyed to the tray.

The protruding member can be moved in the direction opposite to the travel direction of the recording medium after the first edge of the recording media passes through the conveying member to be discharged to the tray and before the recording media falls to the holding member.

A standby position of the protruding member before moving to the direction opposite to the travel direction of the recording media can be determined according to a size of the recording media to be conveyed to the tray.

The movement of the protruding member to a standby position thereof between the discharge of the recording media and the movement of the recording media in the direction opposite to the travel direction of the recording media is performed after the size of a first copy sheet of a next job can be determined.

The movement of the protruding member to a standby position thereof between the discharge of the recording media and the movement of the recording media in the direction opposite to the travel direction of the recording media can be performed after the size of a first copy sheet of a next job is determined.

The discharging member can be moved in the direction opposite to the travel direction of the recording media when the recording media in stack can be positioned.

After the protruding member mounted on the discharging member is moved to the direction opposite to the travel direction of the recording media and the first edge of the recording medium is abutted against the holding member, a position of the protruding member to move can be determined based on whether there is a stack of sheets.

After the protruding member mounted on the discharge member is moved in the direction opposite to the travel direction of the recording media and the first edge of the recording media is abutted against the holding member, a position of the protruding member to move can be determined based on a number of staplings performed to the recording member.

Further, in one embodiment, a novel method of positioning a stack of recording media includes receiving a signal indicating a size of the stack of recording media, confirming information of the signal, moving a protruding member to a standby position according to the size of the stack of recording media, conveying the stack of recording media to a tray, contacting a leading edge of the stack of recording media with the protruding member, and discharging the stack of recording media to an external tray.

Further, in one embodiment, a novel image forming apparatus includes an image bearing member configured to bear an image and a transfer mechanism configured to transfer a recording medium having the image thereon, and a sheet finishing apparatus configured to perform a sheet finishing operation with respect to the recording medium. The sheet finishing apparatus includes a conveying member configured to convey recording media including the recording medium, and a tray configured to receive the recording media conveyed by the conveying member. The tray can include a holding member configured to hold the recording media therein and contact a first edge of the recording media such that the recording media is positioned, a rotatable moving member configured to contact the recording media such that the holding member abuts against the recording media, a discharging member configured to discharge the recording media stacked by the holding member, a protruding member mounted on the discharging member and configured to contact a second edge of the recording media such that the recording media is positioned. One of the rotatable moving member and the protruding member can position the recording media stacked in the tray in a travel direction of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
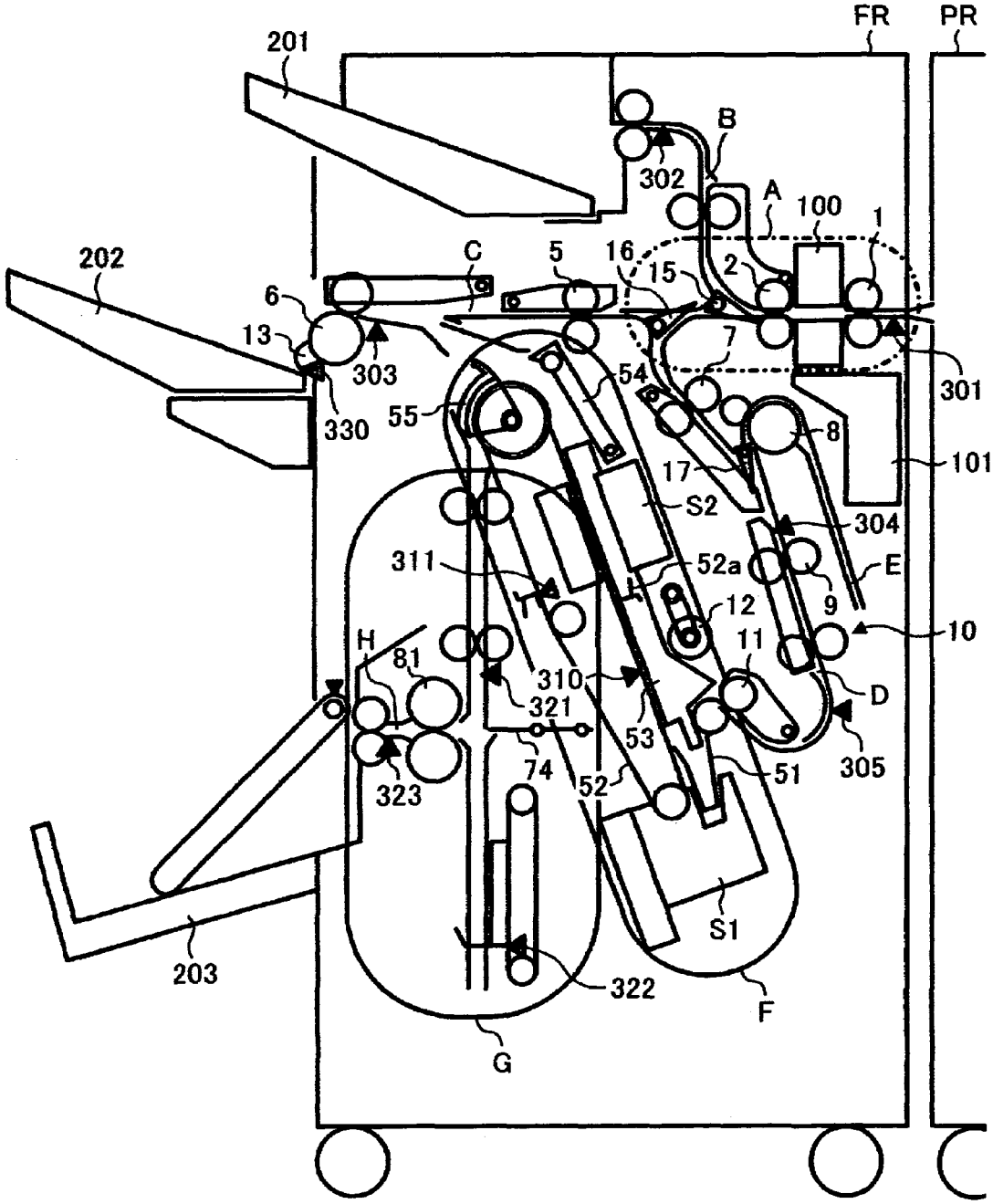
FIG. 1 is a side view of an image forming apparatus and a sheet finishing apparatus mounted thereto according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are disclosed.

Referring to FIG. 1, an image forming apparatus PR and a sheet finishing apparatus FR attached to the image forming apparatus PR according to an exemplary embodiment of the present invention are described.

As shown in FIG. 1, the sheet finishing apparatus FR is operatively connected to one side of the image forming apparatus PR. A recording sheet or recording medium driven out of the image forming apparatus PR is introduced into the sheet finishing apparatus FR.

In the sheet finishing apparatus FR, a plurality of sheet conveying paths are provided. A sheet conveying path A includes a finishing mechanism for finishing a single recording sheet. In the illustrative embodiment, this finishing mechanism is implemented as a punch unit or punching mechanism 100. Path selectors 15 and 16 steer the recording sheet coming in through the sheet conveying path A to any one of a sheet conveying path B terminating at an upper tray 201, a sheet conveying path C terminating at a shift tray 202, and a sheet conveying path D leading to a processing tray F. The processing tray F is used to position, staple or otherwise process a recording sheet or recording sheets and, in this sense, will sometimes be referred to as a staple tray F hereinafter.

Recording sheets sequentially brought to the staple tray F via the sheet conveying paths A and D are positioned one by one, stapled or otherwise processed, and then steered by a stack tray 54 and a movable guide 55 to either one of the sheet conveying path C and another processing tray G. The processing tray G folds or otherwise processes the sheets and, in this sense, will sometimes be referred to as a fold tray G hereinafter. The sheets folded by the fold tray G are guided to a lower tray 203 via a sheet conveying path H.

The sheet finishing path D includes a path selector 17 constantly biased to a position shown in FIG. 2 by a light-load spring, which is not shown. An arrangement is made such that after the trailing edge of a sheet has moved away from the path selector 17, among a prestack roller 8, conveying roller pairs 9 and 10 and a staple outlet roller pair 11, at least the prestack roller 8 and the conveying roller pair 9 are rotated in the reverse direction to convey the trailing edge of the sheet to a prestacking portion E and cause the recording sheet to stay there. In this case, the sheet can be conveyed together with the next recording sheet placed thereon. Such an operation can be repeated to convey two or more recording sheets together.

The staple discharge sensor 305 is disposed at the sheet conveying path D to sense the trailing edge of the recording sheet conveyed by the conveying roller pair 9.

On the sheet conveying path A merging into the sheet conveying paths B, C, and D, there are sequentially arranged an inlet sensor 301 responsive to a recording sheet coming into the finishing apparatus FR, an inlet roller pair 1, the punch unit 100, a waste hopper 101, a sheet conveying roller pair 2, and the path selectors 15 and 16. Springs (not shown) constantly bias the path selectors 15 and 16 to the positions shown in FIG. 1. When solenoids (not shown) are turned on, the path selectors 15 and 16 rotate upward and downward, respectively, to thereby steer the sheet to desired one of the sheet conveying paths B, C and D. More specifically, to guide a recording sheet to the conveying path B, the path selector 15 is held in the position shown in FIG. 1 while the solenoid assigned thereto is turned off.

On the other hand, to guide a sheet to the conveying path C, the solenoids are turned on to rotate the path selectors 15 and 16 upward and downward, respectively. Further, to guide a recording sheet to the conveying path D, the path selector 16 is held in the position shown in FIG. 1 while the solenoid assigned thereto is turned off; at the same time, the solenoid assigned to the path selector 15 is turned on to rotate it upward.

A section of sheet conveying paths toward the shift tray 202 includes a sheet conveying roller pair 5, a shift outlet roller pair 6, a shift outlet sensor 303, and a return roller 13. The sheet conveying roller pair 5 conveys the recording sheets from the path selector 16 via the sheet conveying path C to the shift tray 202. The shift outlet sensor 303 detects the recording sheets conveyed by the sheet conveying roller pair 5. The shift outlet roller pair 6 conveys the recording sheets toward the shift tray 202 after the recording sheet passes the shift outlet sensor 303. The return roller 13 gathers the recording sheets to a predetermined position in the shift tray 202. Various motors, such as a tray motor (not shown) and a shift motor control a direction of movements of the shift tray 202. (See FIGS. 6A and 6B for detail.)

The image forming apparatus PR including the sheet finishing apparatus FR further includes at least an image processor, an optical writing unit, a developing unit, an image transferring unit, a separating unit, a fixing unit, a cleaning unit, and a discharging unit although not shown specifically. The image processor converts an image signal input thereto to image data that can be printed out. The optical writing unit optically scans the surface of a photoconductive element in accordance with the image data output from the image processor, thereby forming an electrostatic latent image. The developing unit develops the electrostatic latent image with toner to thereby produce a corresponding toner image. The image transferring unit transfers the toner image onto a recording sheet. The separating unit separates the recording sheet having the toner image thereon from the photoconductive element. The fixing unit fixes the toner image on the recording sheet. The cleaning unit removes residual toner remaining on the surface of the photoconductive element. The discharging unit discharges residual potential from the surface of the photoconductive element. Since an electrophotographic image forming apparatus is well known, the detailed description will be omitted here.

While the image forming apparatus PR is assumed to execute an electrophotographic process, it can alternatively be of the type executing any other conventional image forming process, e.g., an ink-jet, ink-ribbon, or a thermal transfer image forming process. In the illustrative embodiment, the image processor, optical writing unit, developing unit, image transferring unit and fixing unit constitute an image forming mechanism in combination.

In the illustrative embodiment, the finishing apparatus FR is capable of selectively effecting punching (the punch unit 100), jogging and edge stapling (jogger fences 53 and an edge stapler S1), center stapling (the jogger fences 53 and a pair of center staplers S2), sorting (a shift tray 202) or folding (a fold plate 74, first fold roller pair 81, and second fold roller pair which is not shown, as desired).

Figure 2B:
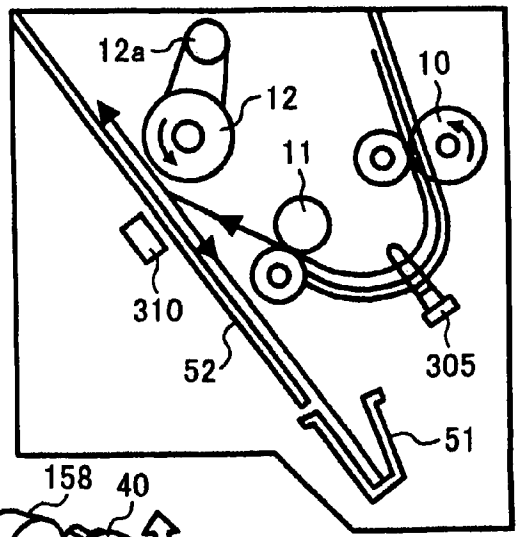
FIG. 2B is a side view of the staple tray of FIG. 2A.
Figure 2A:
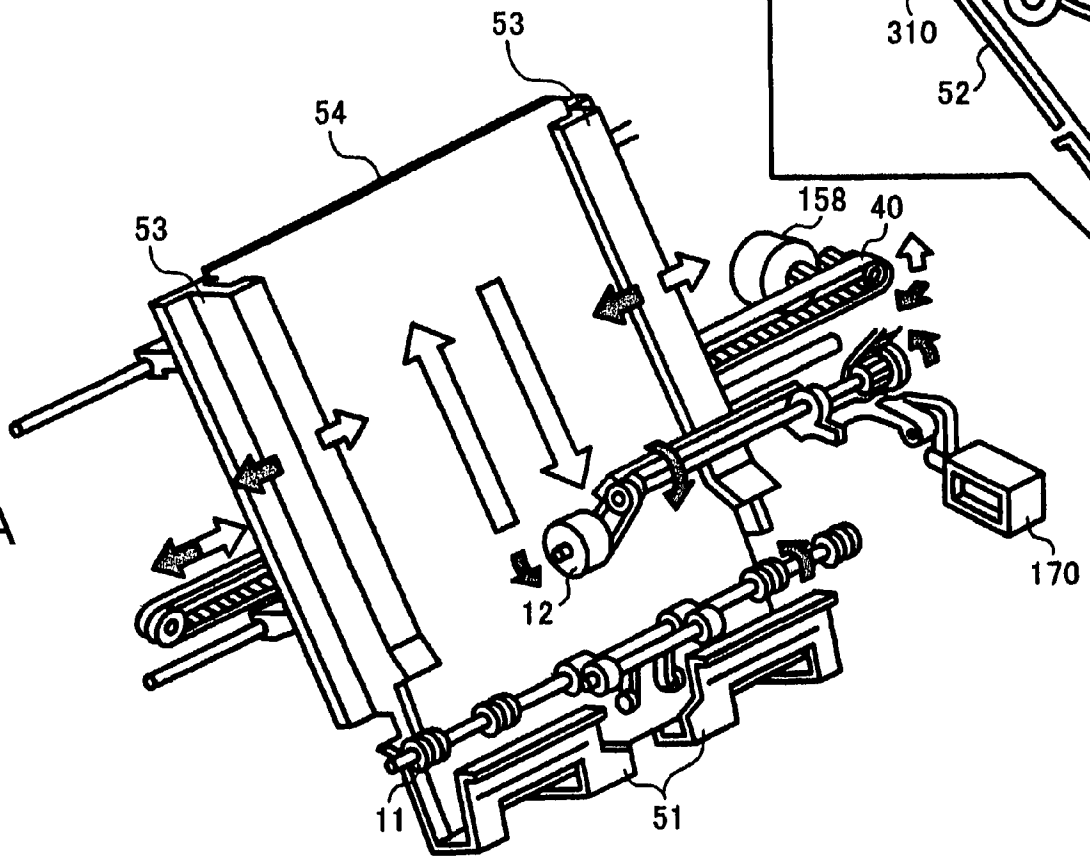
FIG. 2A is an isometric view showing a staple tray and a mechanism for driving the staple tray.
Figure 4:
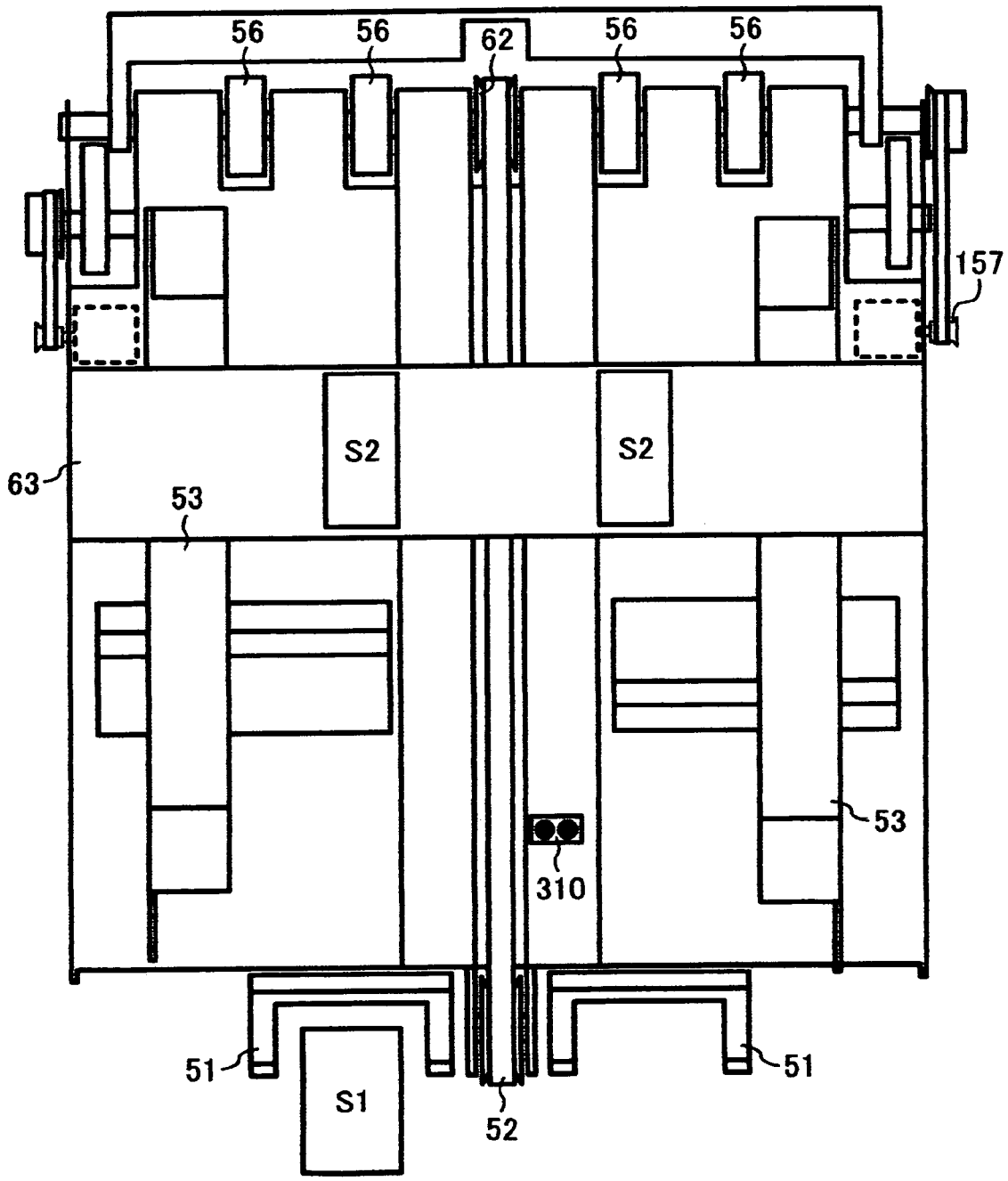
FIG. 4 is a plan view showing the staple tray included in the sheet finishing apparatus, as seen in a direction perpendicular to a sheet conveying surface.

Referring to FIGS. 2A, 2B, and 4, schematic structures and functions of the staple tray F are described.

In FIGS. 2A and 2B, the staple tray F includes jogger fences 53, a jogger motor 158, a jogger belt 40, rear fences 51, a knock roller 12, and a knock solenoid 170. The jogger motor 158 drives the jogger fences 53 via the jogger belt 40. The knock solenoid 170 causes the knock roller 12 to move back and forth in the direction of sheet width so as to contact with the recording medium and force it downward when energized. The rear fences 51 are disposed below the jogger fences 53 so that the recording medium is positioned thereby. The rear fences 51 shown in FIG. 2A are arranged as a pair of fences separated to right and left as shown in FIG. 2A. It is, however, not limited to the arrangement.

The rear fences 51 are disposed at the bottom of the stack tray 54. The stack tray 54 stacks the recording sheets for positioning, and includes the rear fences 51, the jogger fences 53, and the knock roller 12, which form a stacking mechanism. Behind the stack tray 54, a discharge belt 52 serving as a releasing member to release the recording sheet is disposed (see FIG. 1).

In FIG. 2B, the stack of sheets conveyed by the staple outlet roller pair 11 to the staple tray F is sequentially stacked in the staple tray F.

The knock solenoid 170 causes the knock roller 12 to move about a fulcrum 12*a* in a pendulum fashion, so that the knock roller 12 intermittently acts on recording sheets sequentially driven to the staple tray F and causes their trailing edges to abut against the rear fences 51. This can position the stack of sheets in the direction of sheet conveying direction. The knock roller 12 rotates counterclockwise about its axis.

As previously described, the jogger motor 158 drives the jogger fences 53 via the jogger belt 40 and causes them to move back and forth in the direction of sheet width. This can position the stack of sheets in the direction of sheet width, which is perpendicular to the direction of sheet conveying direction.

Figure 3:
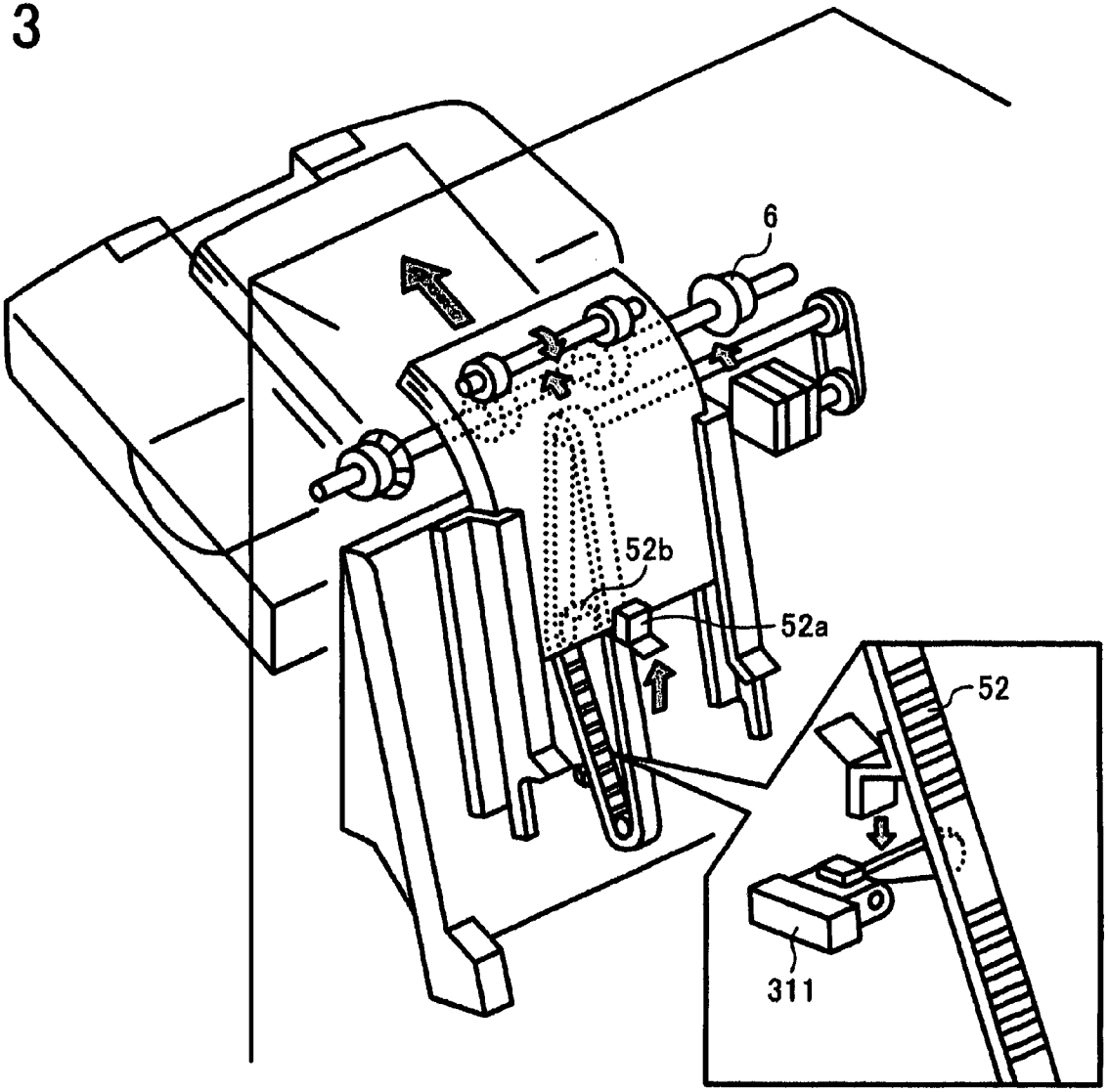
FIG. 3 is an isometric view showing a mechanism included in the sheet finishing apparatus for discharging a stack of sheets.

In FIG. 3, a discharge belt 52 of the staple tray F includes hooks 52*a* and 52*b*, and a belt HP (home position) sensor 311.

The hooks 52*a* and 52*b* are positioned on the discharge belt 52 face-to-face at spaced locations in the circumferential direction and alternately convey the stack of sheets stapled on the staple tray F one after another to an external tray; As shown in FIG. 3, the belt HP sensor 311 senses the hook 52*a* of the discharge belt 52 brought to its home position. The belt HP sensor 311 is turned on and off according to the movement of the hook 52*a*. The discharge belt 52 can be moved in the reverse direction such that the hook 52*a* held in a stand-by position and the back of the hook 52*b* position the leading edge of the sheet stack stored in the staple tray F in the direction of sheet conveyance, as needed.

FIG. 4 shows the staple tray F as seen in a direction perpendicular to the sheet conveyance plane.

In FIG. 4, a discharge motor 157 causes the discharge belt 52 to move via a discharge shaft (not shown). The discharge belt 52 and a drive pulley 62 therefor are positioned at the center of the discharge shaft in the direction of sheet width. Discharge rollers 56 are mounted on the discharge shaft in a symmetrical arrangement. The discharge rollers 56 rotate at a higher peripheral speed than the discharge belt 52.

Figure 5:
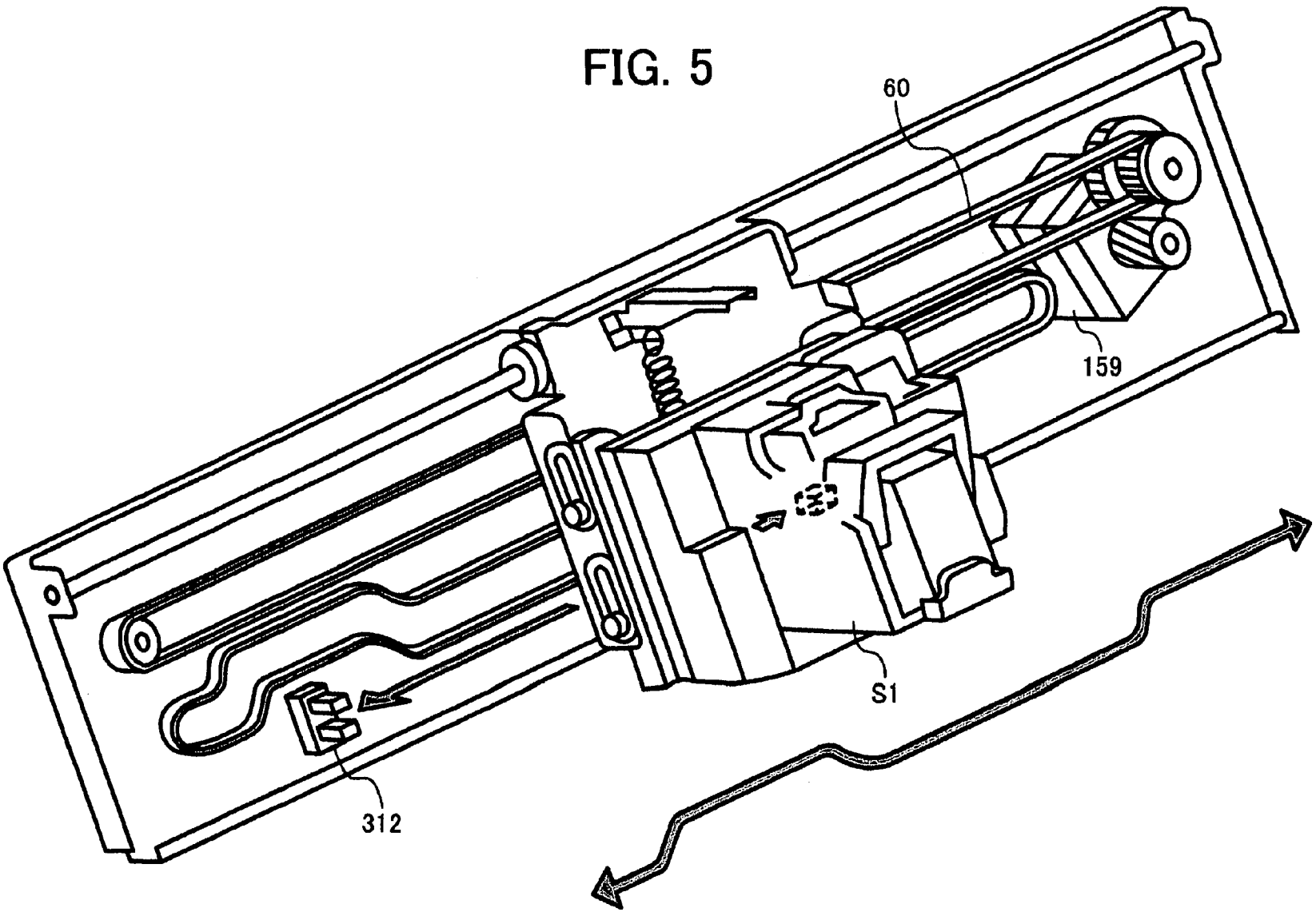
FIG. 5 is an isometric view showing an edge stapler included in the sheet finishing apparatus together with a mechanism for moving the edge stapler.

Referring to FIG. 5, a schematic structure of the edge stapler S1 is described.

The edge stapler S1 is disposed below the rear fences 51 as shown in FIG. 2A and includes a reversible stapler motor 159 for driving the edge stapler S1 via a timing belt 60. The edge stapler S1 is movable in the direction of sheet width in order to staple a stack of sheets at a desired edge position.

A stapler HP sensor 312 is positioned at one end of the movable range of the edge stapler S1 in order to sense the edge stapler S1 brought to its home position. The stapling position in the direction of sheet width is controlled in terms of the displacement of the edge stapler S1 from the home position.

A pair of center staplers S2 is affixed to a stay 63 (see FIG. 4), and are located at a position where the distance between the rear fences 51 and their stapling positions is equal to or greater than one-half of the length of the maximum sheet size, as measured in the direction of conveyance, that can be stapled. The pair of center staplers S2 is symmetrical to each other with respect to the center in the direction of sheet width.

Between consecutive jobs, i.e., during an interval between the last sheet of a stack of sheets and the first sheet of the next stack of sheets, a control unit 350 (see FIGS. 6A and 6B) outputs a staple signal for causing the edge stapler S1 to perform a stapling operation. The discharge belt 52 with the hook 52*a* immediately conveys the stapled stack of sheets to the shift outlet roller pair 6, so that the shift outlet roller pair 6 conveys the sheet stack to the shift tray 202 held at a receiving position.

Figures 6, 6A:
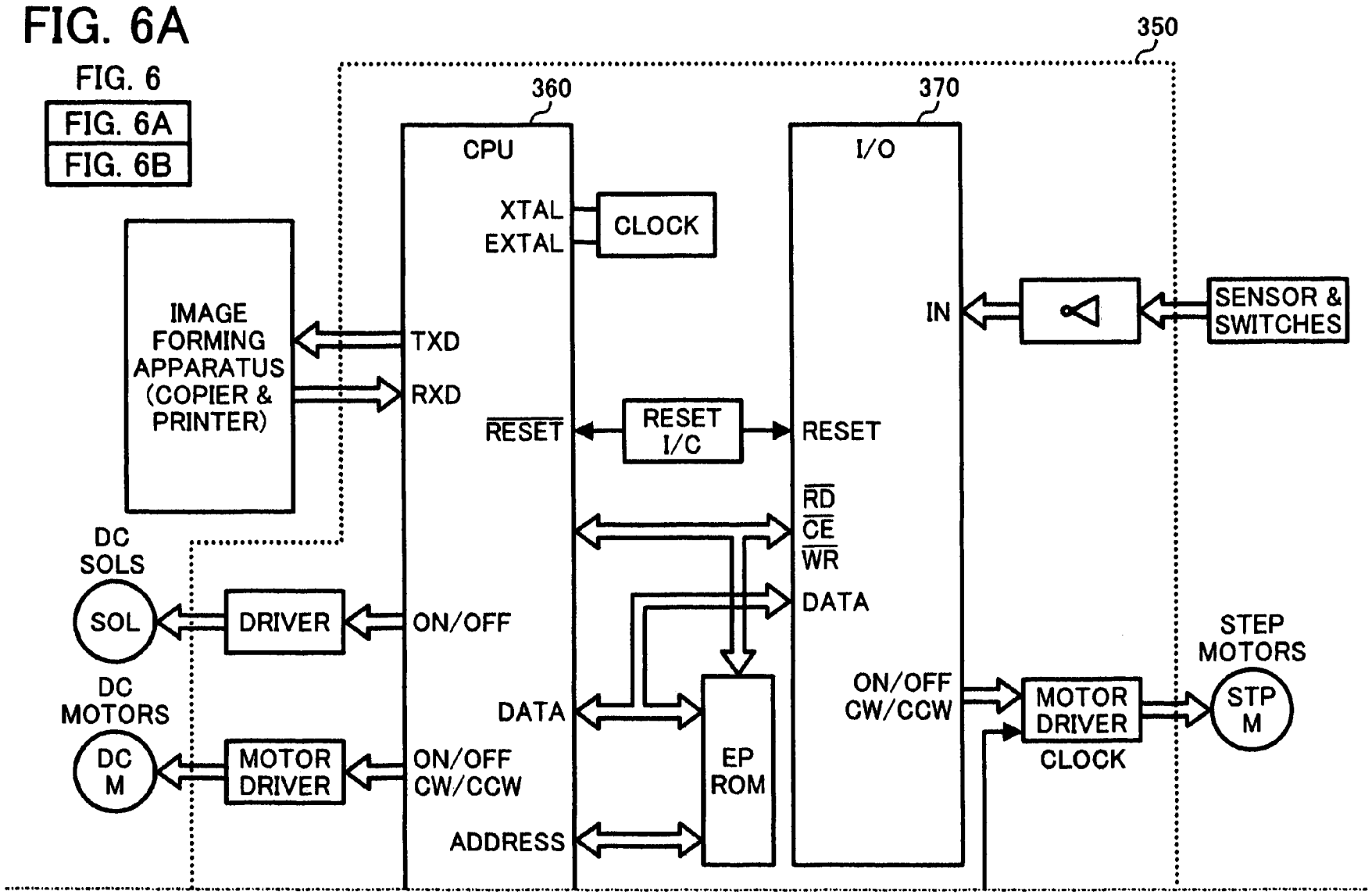
FIGS. 6A and 6B are schematic block diagrams showing a control system included in the image forming system, particularly control circuitry assigned to the sheet finishing apparatus.
Figure 6B:
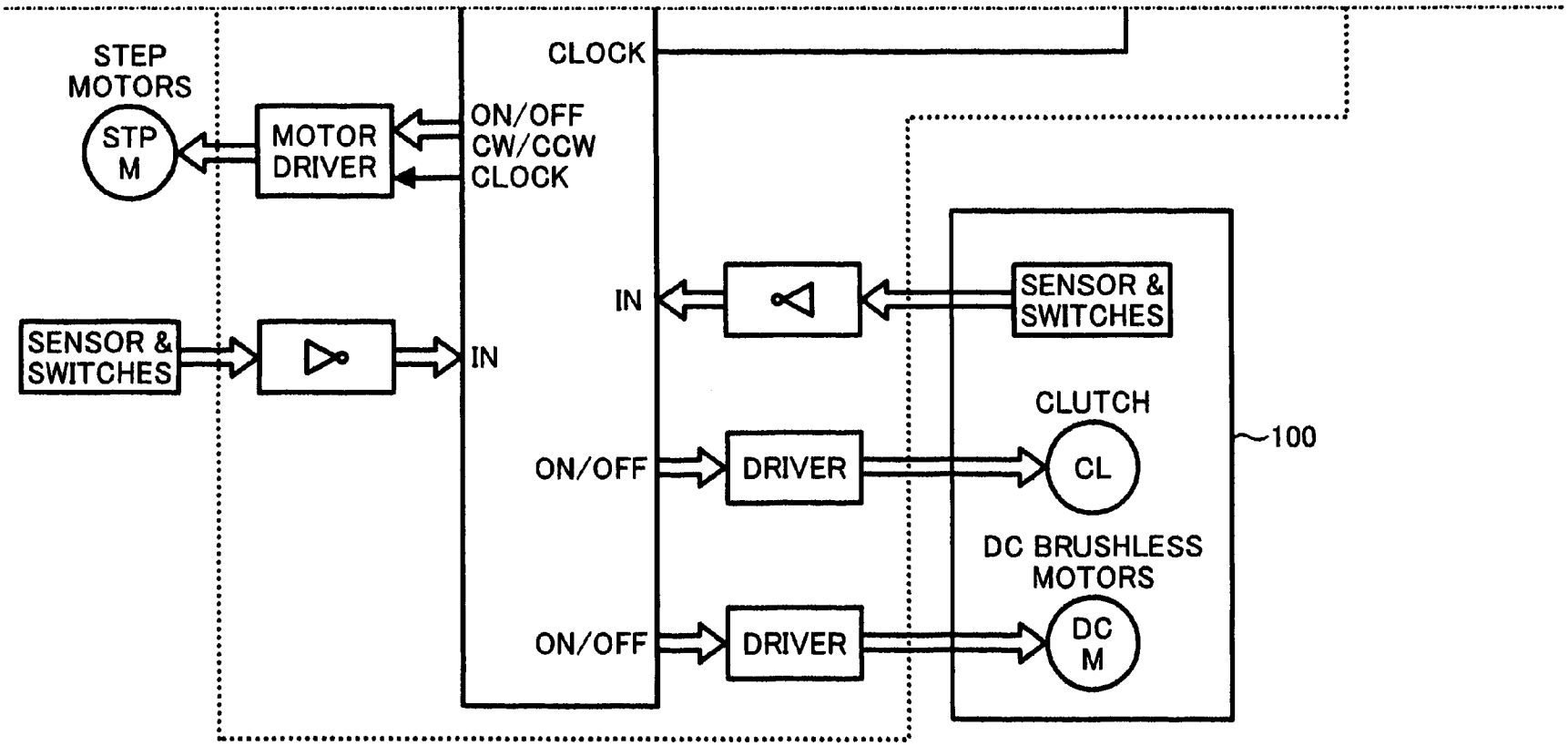

Referring to FIGS. 6A and 6B, a control system included in the illustrative embodiment is described.

As shown in FIGS. 6A and 6B, the control system includes the control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also, the inputs to the control unit 350 via the I/O interface 370 are the output of an inlet sensor 301 (shown in FIG. 1), the output of an upper outlet sensor 302 (shown in FIG. 1), the output of the shift outlet sensor 303 (shown in FIG. 1), the output of a prestack sensor 304 (shown in FIG. 1), the output of a staple discharge sensor 305 (shown in FIGS. 1 and 2B), the output of a sheet sensor 310 (shown in FIGS. 1, 2B, and 4), the output of a belt HP sensor 311 (shown in FIG. 1), the output of the staple HP sensor 312 (shown in FIG. 5), the output of a stapler oblique HP sensor 313 (shown in FIG. 9), the output of a jogger fence HP sensor (not shown), the output of a guide home position sensor (not shown), the output of a stack arrival sensor 321 (shown in FIG. 1), the output of a movable rear fence HP sensor 322 (shown in FIG. 1), the output of a fold position pass sensor 323 (shown in FIG. 1), the output of a lower outlet sensor (not shown), the output of a fold plate HP sensor (not shown), the output of a sheet surface sensor 330 (shown in FIG. 1), and the output of a guide plate sensor (not shown). The sensor signal to be input is connected to an interrupt port, as needed. The CPU 360 serving as a controller controls the control drivers of respective stepping motors, motors other than the stepping motors, and solenoids based on the above-described various input signals.

The control driver of the stepping motors outputs control signals to the motors having the stepping motors, for example, the discharge motor 157 (shown in FIG. 4) assigned to the discharge belt 52, the jogger motor 158 (shown in FIG. 2A) assigned to the jogger fences 53, and the stapler motor 159 (shown in FIG. 5) assigned to the edge stapler S1.

The control driver of the motors other than the stepping motors outputs control signals to the motors having the motors other than the stepping motors, for example, the tray motor and the shift motor (both not shown) assigned to the shift tray 202, the staple motor 159 (shown in FIG. 5) assigned to the edge stapler S1, and a conveyer motor (not shown) assigned to the prestack roller 8 to convey the recording sheet to the prestacking portion E.

The control driver of the solenoids outputs control signals to the solenoids, for example, a switch solenoid (not shown) that switches the path selectors 15 and 16, the knock solenoid 170 (shown in FIG. 2A) that drives the knock roller 12, and a switching solenoid (not shown) that switches the path selector 17 to the prestacking portion E.

<Operations of the Control Unit>

Specific operations to be executed by the CPU 360 in various modes available with the illustrative embodiment will be described hereinafter.

First, in the non-staple mode, a recording sheet is conveyed by the inlet roller 1, passes through the sheet conveying roller pairs 2 and 5 via the sheet conveying path C, and is discharged to the shift tray 202 by the shift outlet roller pair 6. A return roller 13 is disposed in the vicinity of the shift outlet roller pair 6. The return roller 13 contacts the recording sheet driven out by the shift outlet roller pair 6 so that the recording sheet can be positioned at the trailing edge thereof in a stack. At that time, if the shift outlet sensor 303 detects the trailing edge of the recording sheet, the return roller 13 reduces its speed to increase stackability. Further, when the recording sheets having respective images thereon are sequentially output, a shift motor (not shown) lowers the shift tray 202 controlled according to a preselected time to keep an optimal height.

In a sort/stack mode, the recording sheets are also sequentially delivered from the sheet conveying path A to the shift tray 202 via the sheet conveying path C. A difference is that the shift tray 202 is shifted perpendicularly to the direction of sheet discharge copy by copy in order to sort the recording sheets. More specifically, a signal output by a control panel (not shown) of the image forming apparatus PR drives a shift motor (not shown) to shift the shift tray 202 until the end of the job.

Now, a movement of the staple tray F in a staple mode is described.

When the staple mode is selected, each of the jogger fences 53 is moved from the home position to a stand-by position 7 mm short of one end of the width of sheets to be stacked on the staple tray F.

The image forming apparatus PR can issue a signal at the start of a job or every time the image forming apparatus PR outputs the recording sheet. The size of sheet is determined by the signal sent by the image forming apparatus PR at the start of a job.

Further, the hook 52*a* starts to move to a position to receive the recording sheet. The position for the hook 52*a* to standby can depend on which the recording sheet has a prestackable size.

The prestackable size of a recording sheet is limited to a same size as or smaller than a predetermined size. When the size of the recording sheet is greater than that of the predetermined size, the recording sheet cannot be prestacked due to a structural reason. Therefore, the standby position of the hook 52*a* is determined based on the size of the recording sheet to be conveyed.

Figure 7:
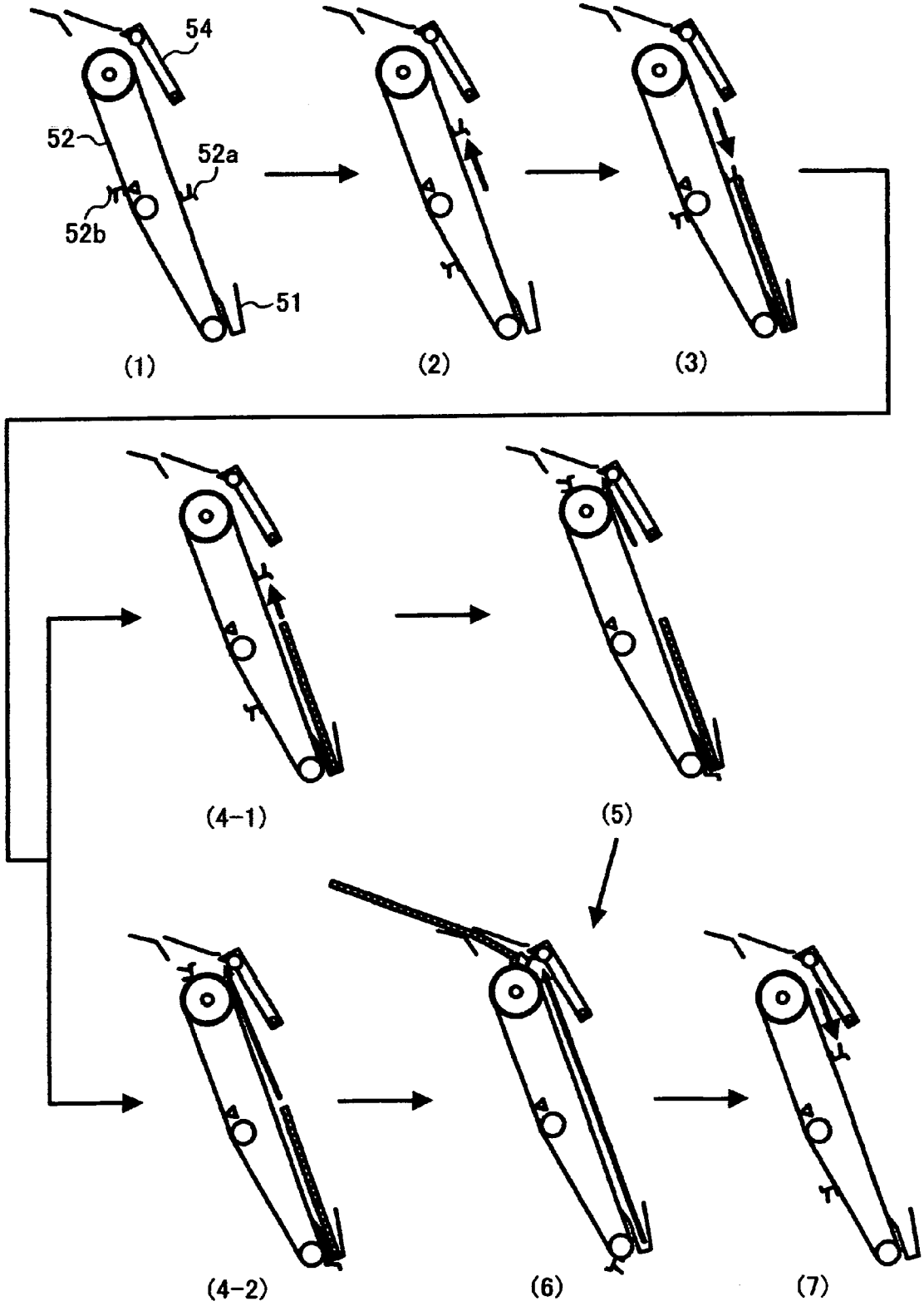
FIG. 7 is a drawing showing movements of hooks mounted on the discharge belt when a prestackable sheet is conveyed to the staple tray.
Figure 8:
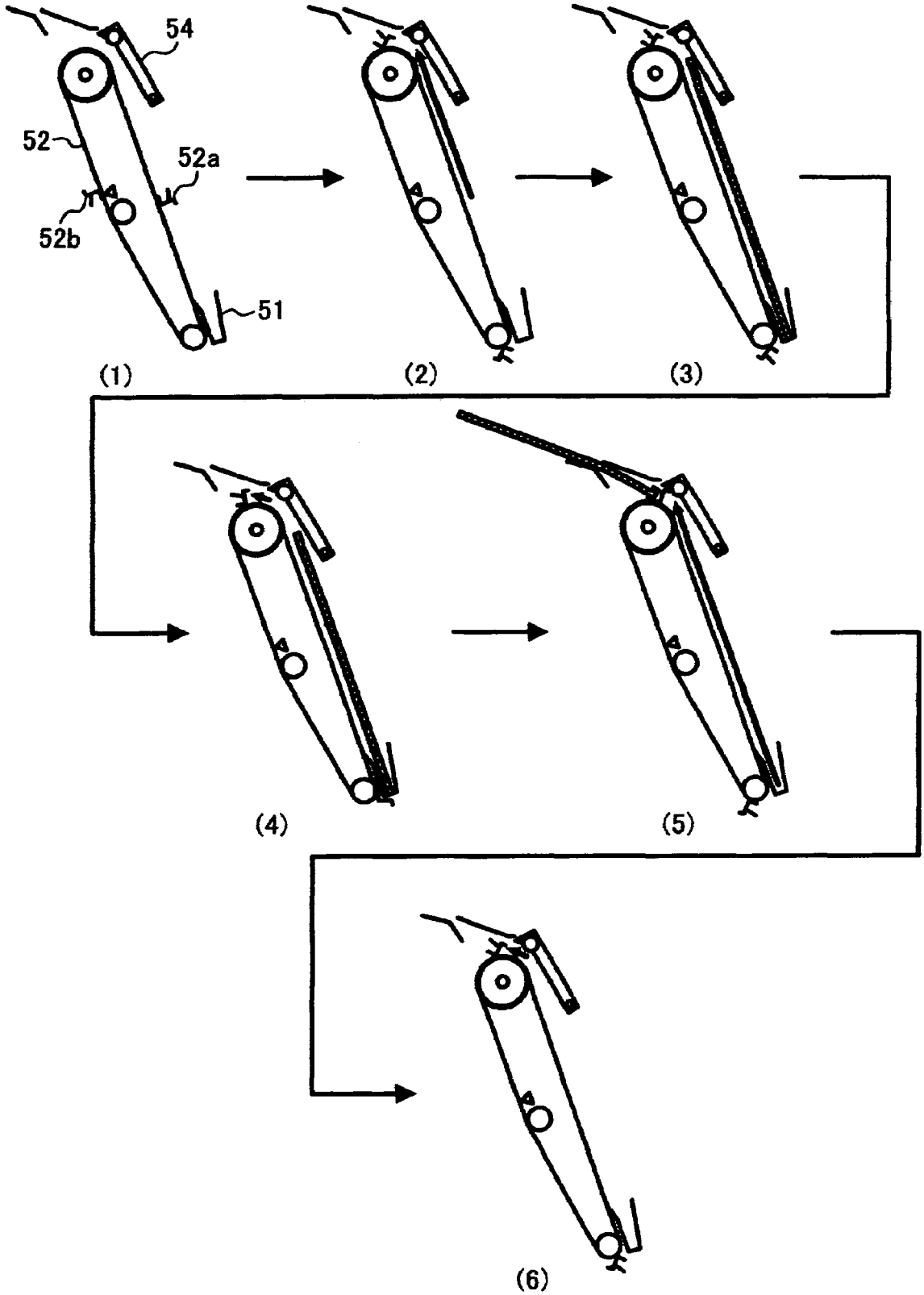
FIG. 8 is a drawing showing movement of the hooks when a non-prestackable sheet is conveyed to the staple tray.

Referring to FIGS. 7(1)-(7) and 8(1)-(6), movements of the hooks 52*a* and 52*b* when receiving the recording sheet are described. FIGS. 7(1)-(7) show the movements of the hooks 52*a* and 52*b* when a prestackable sheet is conveyed to the staple tray F. FIGS. 8(1)-(6) show the movement of the hook 52*a* when a non-prestackable sheet is conveyed to the staple tray F.

FIG. 7(1) and FIG. 8(1) show when the hook 52*a* stays at its home position.

When the recording sheet is conveyed to the staple tray F, the image forming apparatus PR issues a signal indicating the size of the recording sheet. The sheet finishing apparatus FR receives the signal and confirms the information of the sheet size. When the information is confirmed, the hook 52*a* moves to the predetermined standby position according to the sheet size.

When the information indicates the size of the recording sheet is prestackable, the hook 52*a* moves to a standby position to receive the stack of sheets as shown in FIG. 7(2). The standby position of the hook 52*a* of FIG. 7(2) is set to be $\alpha$ mm downstream from the leading edge of the recording sheet stack in the staple tray F. That is, the standby position of the hook 52*a* varies based on the size of the recording sheet to be conveyed.

On the other hand, when the information sent by the image forming apparatus PR indicates the size of the recording sheet is not prestackable, the hook 52*a* moves to the standby position as shown in FIG. 8(2), which is further downstream from the leading edge of the recording sheet stack in the staple tray F. This movement of the hook 52*a* allows a recording sheet having a size greater than the predetermined size to be stacked in the stack tray F. After the hook 52*a* moves to the above-described standby position, the recording sheet is conveyed, as shown in FIG. 8(3). The more the hook 52*a* moves downstream of the direction in which the recording sheet travels, the closer the hook 52*b* comes to the rear fences 51. FIG. 8(4) shows the hook 52*b* is moved to a position closer to the rear fences 51. When the image forming apparatus PR sends a staple signal, the stapling operation can be performed to the stack of sheets in the staple tray F, then the stack of sheets can be discharged from the stack tray F, as shown in FIG. 8(5). When the image forming apparatus PR does not send the staple signal, the stack of sheets can be discharged from the stack tray F, without performing the stapling operation. After the stack of sheets are completely discharged, the image forming apparatus PR sends new information to the sheet finishing apparatus FR. When the sheet finishing apparatus FR confirms the information, the hook 52*a* moves to the standby position according to the size of a next recording sheet, as shown in FIG. 8(6).

When a first copy sheet enters the sheet conveying path toward the staple tray F, the path selector 17 allows the first copy sheet to move forward to the prestacking portion E so that the sheet conveying roller pair 8 driven by the corresponding conveyer motor can convey the recording sheet. When the first copy sheet reaches a predetermined position, the conveyer motor stops, which stops the travel of the recording sheet. A second copy sheet, on the other hand, is conveyed to the sheet conveying path D. When the leading edge of the second copy sheet comes to the same position as that of the first copy sheet stack in the prestacking portion E, the conveyer motor drives the sheet conveying roller pair 8 so that the first and second copy sheets are conveyed together.

When the trailing edge of the recording sheets conveyed by the staple outlet roller pair 11 passes the staple discharge sensor 305, each of the jogger fences 53 is moved inward from the stand-by position by 5 mm.

The staple discharge sensor 305 senses the trailing edge of the sheet and sends its output to the CPU 360 shown in FIGS. 6A and 6B. In response, the CPU 360 starts counting drive pulses input to the staple motor (not shown) driving the staple discharge roller pair 11. On counting a predetermined number of pulses, the CPU 360 energizes the knock solenoid 170 when a single recording sheet is conveyed in the sheet conveying paths. That is, when the stack of sheets is conveyed in the sheet conveying paths, the CPU 360 does not turn on the knock solenoid 170.

The knock solenoid 170 causes the knock roller 12 to contact the sheet in a pendulum fashion and force it downward when energized, so that the sheet can be positioned by the rear fences 51.

<Positioning a Plurality of Sheets>

Further, when a plurality of recording sheets stacked in the sheet conveying paths are conveyed, the sheet finishing apparatus FR according to the present invention can position with the hooks 52*a* and 52*b*. That is, the knock roller 12 cannot be used to abut the stack of sheets to the rear fences 51 so as to position the stack of sheets in the travel direction thereof.

The hook 52*a* can perform the positioning in the travel direction of the stack of sheets at a period of time after the stack of sheets passes the staple outlet roller pair 11 and before the stack of sheets falls to the rear fences 51.

Conventionally, the positioning of the leading edge of the sheets has been performed by the knock roller 12 when a plurality of sheets in a stack is conveyed. However, it has been difficult to adjust the misalignment of the leading edge thereof, and easy to cause the problems related to the misalignment. Especially when the number of sheet increases, it becomes more difficult to adjust the misalignment.

The sheet finishing apparatus FR sets a timing to knock the leading edge of the stack of sheets using the hook 52*a* to the period of time before the stack of sheets falls on the rear fences 51 that receives the stack of sheets. By setting the timing as described above, the stack of sheets in the travel direction thereof can be positioned with the hook 52*a*. That is, the knock roller 12 is not used to position the stack of sheets in the sheet finishing apparatus FR according to the present invention.

More specifically, as previously described, the staple discharge sensor 305 senses the trailing edge of the sheet and sends its output to the CPU 360. In response, the CPU 360 starts counting drive pulses input to the staple motor (not shown). After a predetermined number of pulses are counted, the CPU 360 turns on the discharge motor 157 to cause the discharge belt 52 to move in a reverse direction so that the hook 52*a* can contact the leading edge of the stack of sheets and force it downward to contact with the rear fences 51 for positioning.

By not using the knock roller 12, operability of the positioning can be increased. Further, the positioning using the hook 52*a* can be made when the stack of sheets is aloft and lets air through between the recording sheets. In other words, the positioning using the hook 52*a* can be made when the sheets in the stack are not pressed against each other. The above-described condition cannot cause conventional problems in positioning and can allow a stable positioning operation.

By having the two hooks 52*a* and 52*b* mounted on the discharge belt 52, productivity of the sheet finishing apparatus FR can increase. It is because the above-described structure can reduce the time by moving a hook to its standby position after the other hook contacts the leading edge of the stack of sheets and discharges the stack of sheets to an external tray.

The standby position of the hook 52*a* after contacting the leading edge of the stack of sheets for positioning can be determined based on whether the stapling operation is performed to the stack of sheets. When the stapling operation is performed, the CPU 360 confirms a position or positions for stapling, and determines the position to which the hook 52*a* is moved. Namely, the CPU 360 determines whether the hook 52*a* is moved to the standby position for receiving the stack of sheets or the position in the vicinity of the rear fences 51 for discharging the stack of sheets without stapling.

Referring back to FIG. 7, the operation of the hooks 52*a* and 52*b* are described.

Firstly, the operation of the hooks 52*a* and 52*b* after the completion of the positioning of the recording sheet without stapling and continuing to receive the recording sheet is shown.

In FIG. 7(2), the hook 52*a* is moved to the standby position for receiving the recording sheet stack in the prestacking portion E. After the hook 52*a* is moved to the above-described standby position, the recording sheet is conveyed to the staple tray F. The hook 52*a* is moved in the reverse direction toward the leading edge of the recording sheet to contact thereto for positioning, as shown in FIG. 7(3). The hook 52*a* is then moved to the position slightly downstream of the travel direction of the recording sheet, as shown in FIG. 7(4-1). The stack tray F continues to receive the recording sheet. After the recording sheet responding to the staple signal is stacked in the staple tray F, the hook 52*b* is moved to the position in the vicinity of the rear fences 51, as shown in FIG. 7(5). The stapling operation is performed to the stack of recording sheets in the stack tray F, and the hook 52*b* is moved to discharge the stack of sheets to the external tray. After the stack of sheets is completely discharged, the image forming apparatus PR sends new information to the sheet finishing apparatus FR. When the sheet finishing apparatus FR confirms the information, the hook 52*a* moves to the standby position according to the size of a next recording sheet, as shown in FIG. 7(7).

Next, the operation of the hooks 52*a* and 52*b* after the completion of the positioning of the recording sheet and the stapling operation to the recording sheet are shown. In this case, the hook 52*a* is moved to different positions after completing one stapling and two stapling.

In one stapling, as shown in FIG. 7(3), the hook 52*a* contacts the leading edge of the recording sheet in the staple tray F for positioning. The hook 52*a* is moved to the position in the vicinity of the rear fences 51, while the edge stapler S1 performs the stapling operation, as shown in FIG. 7(4-2). When the CPU 360 confirms both the completion of the stapling operation and the shift of the hook 52*a* to the position in the vicinity of the rear fences 51, the stack of sheets is discharged, as shown in FIG. 7(6). As described above, the stapling operation performed by the edge stapler S1 can be made simultaneously with the shift of the hook 52*a* to the position in the vicinity of the rear fences 51, which can reduce the period of operation of the stack tray F in the sheet finishing apparatus FR. Alternatively, the movement of the hook 52*a* to the position in the vicinity of the rear fences 51 can be performed after the stapling operation by the edge stapler S1 is completed.

After the stack of sheets is completely discharged to the external tray, the image forming apparatus PR sends new information to the sheet finishing apparatus FR. When the sheet finishing apparatus FR confirms the information, the hook 52*a* moves to the standby position according to the size of a next recording sheet, as shown in FIG. 7(7).

In two stapling, the hook 52*a* contacts the leading edge of the recording sheet in the staple tray F for positioning, as shown in FIG. 7(3), which is the same as the operation in one stapling. After the first stapling operation by the edge stapler S1, the hook 52*a* is moved to the position slightly downstream of the travel direction of the recording sheet, as shown in FIG. 7(4-1). With the hook 52*a* staying in the above described position, the edge stapler S1 is moved to a position for the second stapling for two stapling. At this time, if the hook 52*b* is positioned in the vicinity of the rear fences 51 as shown in FIG. 7(4-2), the hook 52*a* can interfere with the edge stapler S1 to disturb the move of the edge stapler S1. When the hook 52*b* is positioned as shown in FIG. 7(4-1), the edge stapler S1 can move to the position for the second stapling.

After the hook 52*b* is moved to the position as shown in FIG. 7(4-1) and the edge stapler S1 is moved to the position for the second stapling, the edge stapler S1 performs the second stapling to the stack of sheets in the staple tray F. At the same time the second stapling is performed, the hook 52*b* is moved to the position in the vicinity of the rear fences 51, as shown in FIG. 7(5). When the CPU 360 confirms both the completion of the stapling operation and the shift of the hook 52*b* to the position in the vicinity of the rear fences 51, the hook 52*b* is moved so that the stack of sheets can be discharged to the external tray, as shown in FIG. 7(6).

Alternatively, the movement of the hook 52*b* to the position in the vicinity of the rear fences 51 can be performed after the second stapling operation is completed, or the second stapling operation can be performed after the hook 52*b* is moved to the position in the vicinity of the rear fences 51.

After the stack of sheets is completely discharged to the external tray, the image forming apparatus PR sends new information to the sheet finishing apparatus FR. When the sheet finishing apparatus FR confirms the information, the hook 52*a* moves to the standby position according to the size of a next recording sheet, as shown in FIG. 7(7). Every time a recording sheet to be stacked on the staple tray F passes the inlet sensor 301 or the staple discharge sensor 305, the output of the sensor 301 or 305 is sent to the CPU 360, causing the CPU 360 to count the number of recording sheets. At this time, when the recording sheet is stacked in the prestacking portion E, the CPU 360 counts the recording sheet every time the recording sheet is stacked in the prestacking portion E. When the plurality of recording sheets is discharged from the prestacking portion E to the staple tray F, the output of the staple discharge sensor 305 is sent to the CPU 360, causing the CPU 360 to additionally count the number of recording sheets and to store the count therein.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next recording sheet. The CPU 360 repeats such a procedure up to the last page. The CPU 360 again causes the jogger fences 53 to move inward by 7 mm and then stop, thereby causing the jogger fences 53 to retain the opposite edges of the sheet stack to be stapled. Subsequently, on the elapse of a preselected period of time, the CPU 360 drives the edge stapler S1 via the staple motor 160 for thereby stapling the stack of sheets.

Figure 9:
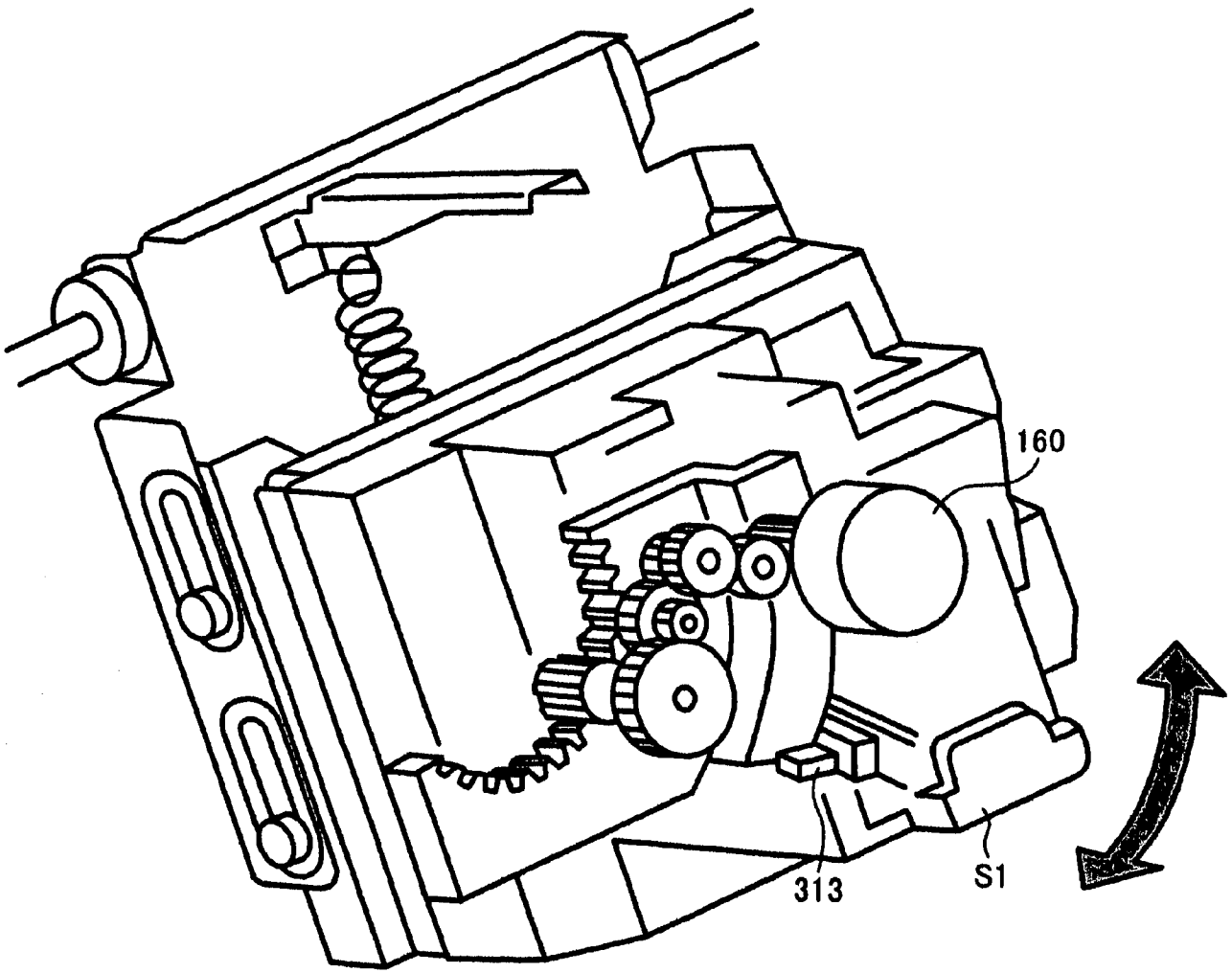
FIG. 9 is an isometric view showing a mechanism for rotating the edge stapler.

Referring to FIG. 9, a mechanism of the edge stapler S1 of the sheet finishing apparatus FR according to the embodiment of the present invention is described.

If two or more stapling positions are designated, then the CPU 360 moves, after stapling at one position, the edge stapler S1 to another designated position along the rear edge of the stack of sheets via the stapler motor 159. At this position, the edge stapler S1 again staples the stack of sheets. This is repeated when three or more stapling positions are designated.

After the stapling operation, the CPU 360 drives the discharge belt 52 via the discharge motor 157. At the same time, the CPU 360 drives the outlet motor to cause the shift outlet roller pair 6 to start rotating in order to receive the stapled sheet stack lifted by the hook 52*a*. At this instant, the CPU 360 controls the jogger fences 53 in a different manner in accordance with the sheet size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack.

When a preselected number of pulses is output since the turn-on of the sheet sensor 310 or the belt HP sensor 311, the CPU 360 causes the jogger fences 53 to retract by 2 mm and release the stack of sheets. The preselected number of pulses corresponds to an interval between the time when the hook 52*a* contacts the trailing edge of the stack of sheets and the time when it moves away from the upper ends of the jogger fences 53.

When the number of folded sheets is equal to or greater than the preselected number of sheets or when the size of folded sheets is equal to or greater than the preselected size of sheets, the CPU 360 causes the jogger fences 53 to retract by 2 mm and release the stack of sheets. In any case, as soon as the stapled sheet stack moves away from the jogger fences 53, the CPU 360 moves the jogger fences 53 further outward by 5 mm to the stand-by positions for thereby preparing it for the next sheet. The binding force can be adjusted according to the distance of the jogger fences 53 with respect to a recording sheet.

When the stack of sheets is discharged to the external tray by moving the hook 52*a*, the hook 52*a* needs to be moved to receive the next sheet. However, the hook 52*a* can be moved after the size of the first copy sheet of the next job is determined. By controlling the movement of the hook 52*a* as described above, the control of the stack tray F can easily be performed even if the size of the first copy sheet of the first job and that of the second job are different.

Figures 10, 10A:
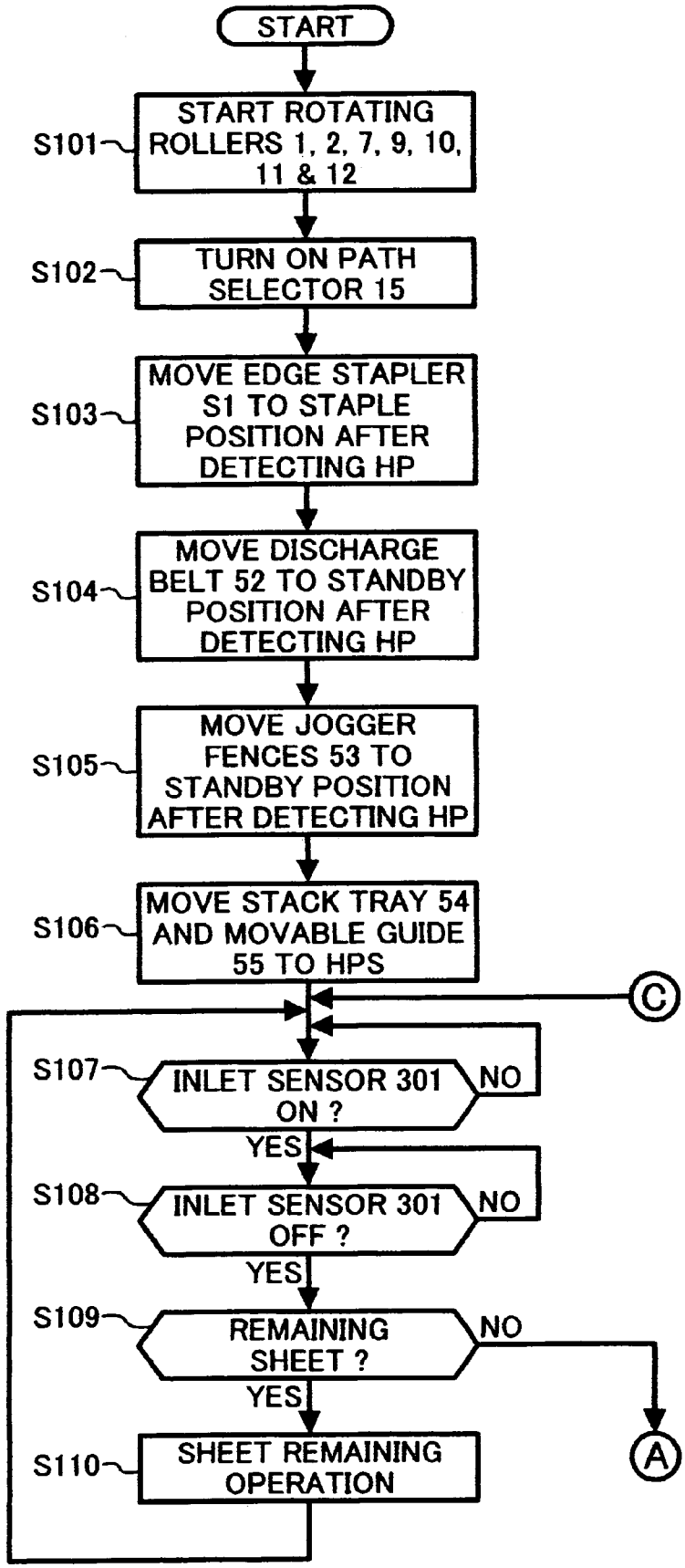
FIGS. 10A, 10B and 10C are flowcharts showing a sheet finishing operation performed by the sheet finishing apparatus.
Figure 10B:
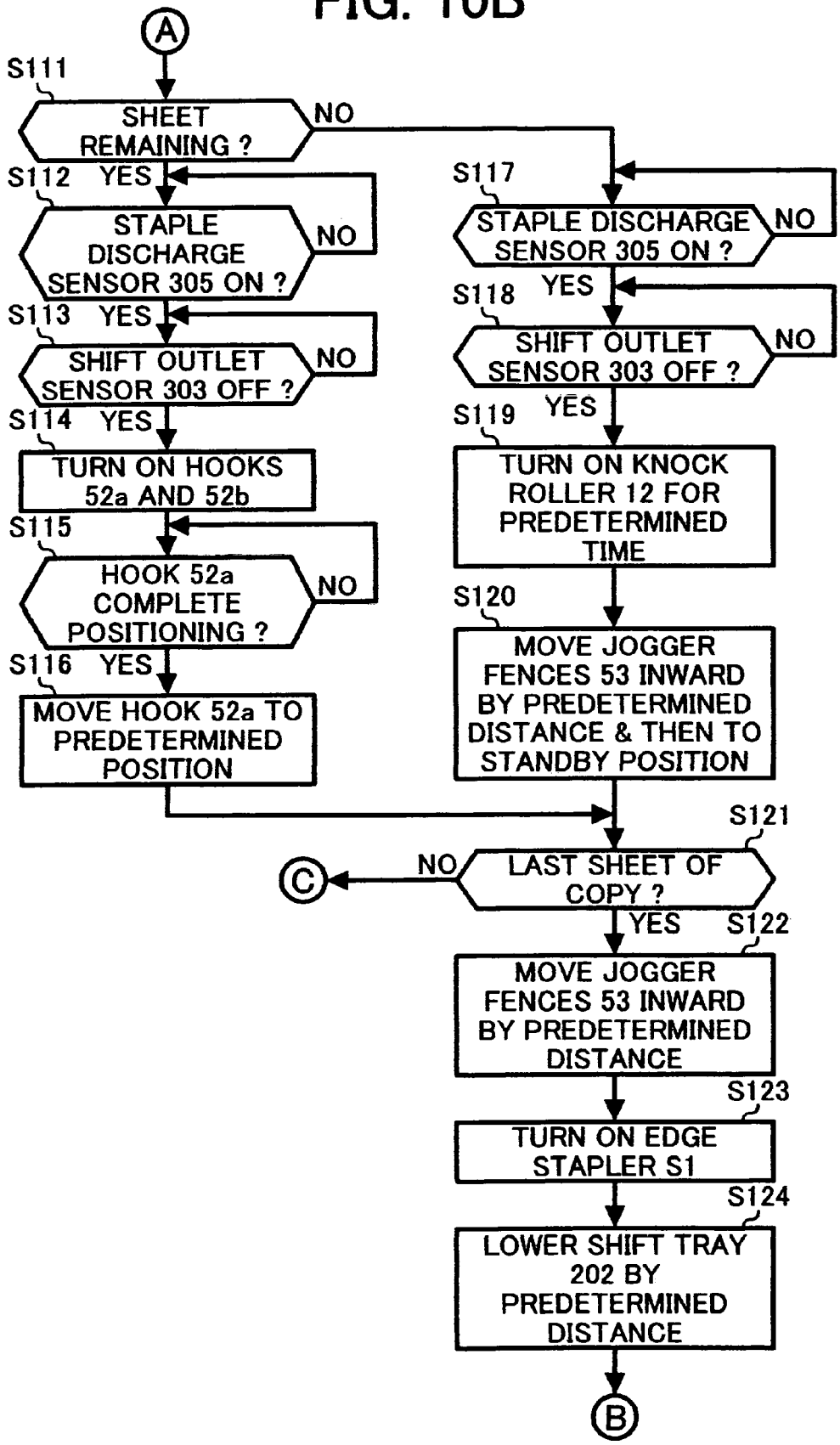
Figure 10C:
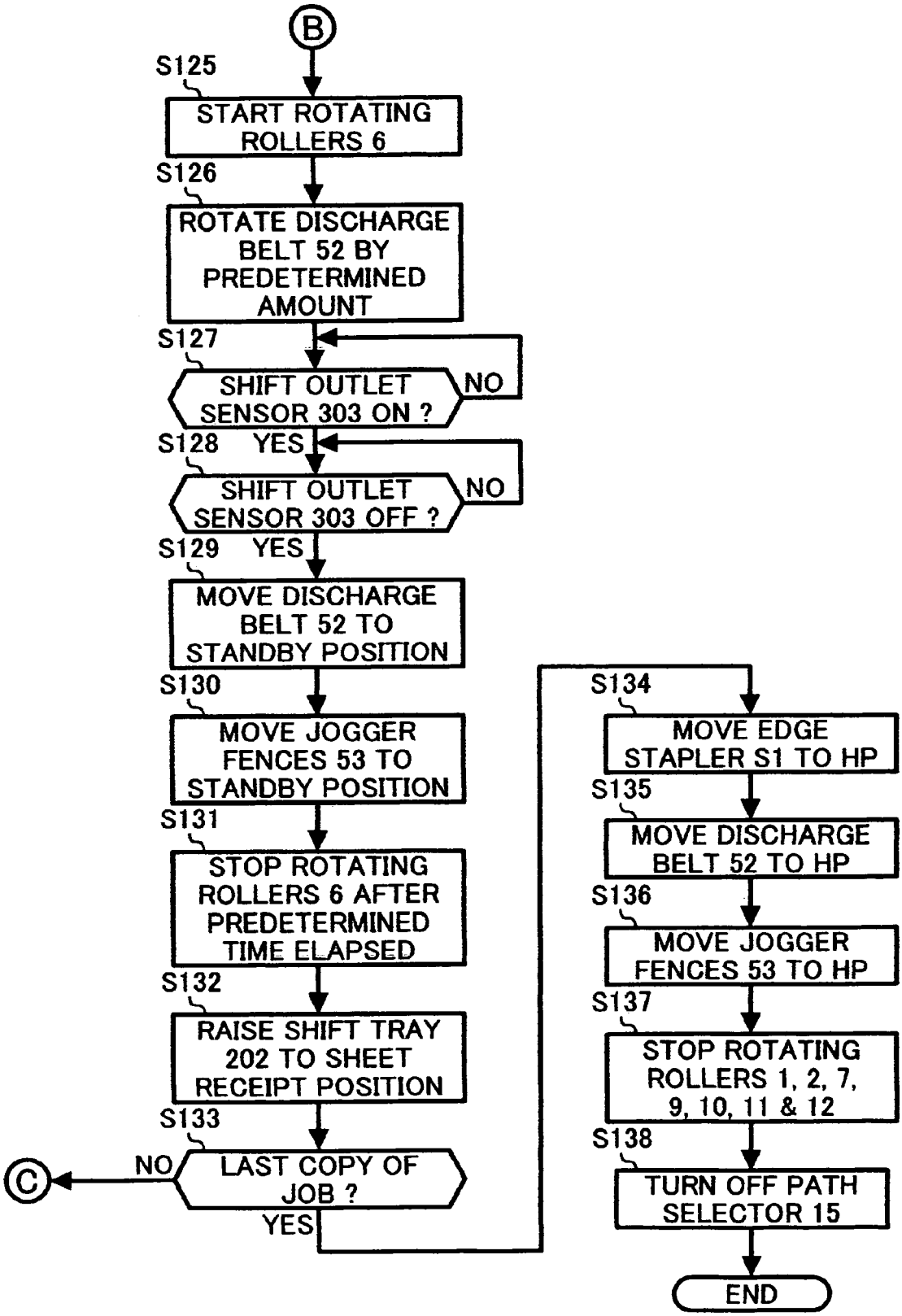

Referring to FIGS. 10A, 10B, and 10C, a flowchart is depicted showing a sheet finishing operation performed by the sheet finishing apparatus FR.

As shown in FIGS. 10A, 10B, and 10C, before a recording sheet driven out of the image forming apparatus PR enters the finishing apparatus FR, the CPU 360 causes the inlet roller pair 1, the conveying roller pair 2 on the sheet conveying path A, a conveying roller pair 7, the conveying roller pairs 9 and 10, the staple outlet roller 11 on the sheet conveying path D, and the knock roller 12 to start rotating in step S101. The CPU 360 then turns on the solenoid assigned to the path selector 15 in step S102 to thereby cause the path selector 15 to rotate counterclockwise.

After the stapler HP sensor 312 has sensed the edge stapler S1 at the home position, the CPU 360 drives the stapler motor 159 to move the edge stapler S1 to a preselected stapling position in step S103. Also, after the belt HP sensor 311 has sensed the discharge belt 52 at the home position, the CPU 360 drives the discharge motor 157 to bring the discharge belt 52 to a stand-by position in step S104. Further, after the jogger fence motor HP sensor (not shown) has sensed the jogger fences 53 at the home position, the CPU 360 moves the jogger fences 53 to a stand-by position in step S105. In addition, the CPU 360 causes the stack tray 54 and movable guide 55 to move to their home positions in step S106.

In step S107, the CPU 360 determines whether the inlet sensor 301 has turned on. When the inlet sensor 301 has turned on, the result of step S107 is YES, and the process proceeds to step S108. When the inlet sensor 301 has not turned on, the result of step S107 is NO, and the process repeats the procedure until the result of step S107 becomes YES. In step S108, the CPU 360 determines whether the inlet sensor 301 has turned off. When the inlet sensor 301 has turned off, the result of step S108 is YES, and the process proceeds to step S109. When the inlet sensor 301 has not turned off, the result of step S108 is NO, and the process repeats the procedure until the inlet sensor 301 turns off.

In step S109, the CPU 360 determines whether there is a sheet to be stacked. When there is a sheet to be stacked, the result of step S109 is YES, and the process proceeds to step S110. When there is no sheet to be stacked, the result of step S109 is NO, and the process goes to step S111. In step S110, a sheet stacking operation is performed, then the process goes back to step S107.

In step S111, the CPU 360 determines whether there is a stack of sheets. When there is a stack of sheets, the result of step S111 is YES, and the process goes to step S112. When there is not a stack of sheets, the result of step S111 is NO, and the process goes to step S117.

In step S112, the CPU 360 determines whether the staple discharge sensor 305 has turned on. When the staple discharge sensor 305 has turned on, the result of step S112 is YES, and the process proceeds to step S113. When the result of step S112 is NO, the process repeats the procedure until the staple discharge sensor 305 turns on.

In step S113, the CPU 360 determines whether the staple discharge sensor 305 has turned off. When the staple discharge sensor 305 has turned off, the result of step S113 is YES, and the process proceeds to step S114. When the staple discharge sensor 305 has not turned off, the result of step S113 is NO, and the process repeats the procedure until the staple discharge sensor 305 turns off.

In step S114, the hooks 52*a* and 52*b* are turned on, and the process goes to step S115.

In step S115, the CPU 360 determines whether the hook 52*a* has completed the positioning of the leading edge of the stack of sheets. When the hook 52*a* has completed the positioning of the leading edge of the stack of sheets, the result of step S115 is YES, and the process goes to step S116. When the hook 52*a* has not completed the positioning of the leading edge of the stack of sheets, the result of step S115 is NO, and the process repeats the procedure until the hook 52*a* completes the positioning. In step S116, the hook 52*a* returns to the predetermined position, and the process goes to the step S121.

In step S117, the CPU 360 determines whether the staple discharge sensor 305 has turned on. When the staple discharge sensor 305 has turned on, the result of step S117 is YES, and the process proceeds to step S118. When the result of step S117 is NO, the process repeats the procedure until the staple discharge sensor 305 turns on.

In step S118, the CPU 360 determines whether the staple discharge sensor 305 has turned off. When the staple discharge sensor 305 has turned off, the result of step S118 is YES, and the process proceeds to step S119. When the staple discharge sensor 305 has not turned off, the result of step S118 is NO, and the process repeats the procedure until the staple discharge sensor 305 turns off.

In step S119, the CPU 360 turns on the knock roller 12 for a preselected period of time to contact the recording sheet. Subsequently in step S120, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position.

In step S121, the CPU 360 determines whether the last sheet of a copy arrives at the staple tray F. When the last sheet has arrived, the result of step S121 is YES, and the process proceeds to step S122. When the last sheet has not arrived yet, the result of step S121 is NO, and the process goes back to step S107.

In step S122, the CPU 360 moves the jogger fences 53 inward to a position where they prevent the edges of the sheets from being dislocated. In this condition, the CPU 360 turns on the edge stapler S1 and causes it to staple the edge of the sheet stack in step S123.

In step S124, the CPU 360 lowers the shift tray 202 by a preselected amount in order to produce a space for receiving the stapled sheet stack. The CPU 360 then drives the shift discharge roller pair 6 via the shift discharge motor in step S125, and the discharge belt 52 by a preselected amount via the discharge motor 157 in step S126, so that the stapled sheet stack is raised toward the sheet conveying path C. As a result, the stapled sheet stack is driven out to the shift tray 202 via the shift outlet roller pair 6.

In step S127, the CPU 360 checks whether the shift outlet sensor 303 has turned on. When the shift outlet sensor 303 has turned on, the result of step S127 is YES, and the process proceeds to step S128. When the shift outlet sensor 303 has not turned on, the result of step S127 is NO, and the process repeats the procedure until the shift outlet sensor 303 turns on. Then, the CPU 360 checks in step S128 whether the shift outlet sensor 303 has turned off. When the shift outlet sensor 303 has turned off, the result of step S128 is YES, the process proceeds to step S129. When the shift outlet sensor 303 has not turned off, the result of step S128 is NO, and the process repeats the procedure until the shift outlet sensor 303 turns off.

In step S129, the sheet stack has moved away from the sensor 303. In this case, the CPU 360 moves the discharge belt 52 to its stand-by position. The CPU 360 then moves the jogger fences 53 to its stand-by position in step S130.

After step S130, the CPU 360 causes the shift outlet roller pair 6 to stop rotating on the elapse of a preselected period of time in step S131, and then raises the shift tray 202 to a sheet receiving position in step S132. The rise of the shift tray 202 is controlled in accordance with the output of the sheet surface sensor 330 responsive to the top of the sheet stack positioned on the shift tray 202.

The CPU 360 then determines whether or not the discharged sheet is the last copy or set of sheets in step S133. When the discharged sheet is the last copy, the result of step S133 is YES, and the process proceeds to step S134. When the discharged sheet is not the last copy, the result of step S133 is NO, and the process goes back to step S107.

Then, the CPU 360 moves the edge stapler S1 to its home position in step S134. In step S135, the CPU 360 moves the discharge belt 52 to its home position. And, in step S136, the CPU 360 moves the jogger fences 53 in to its home position.

After step S136, the CPU 360 causes the inlet roller pair 1, the conveying roller pairs 2, 7, 9 and 10, the staple discharge roller pair 11 and the knock roller 12 to stop rotating in step S137. Further, the CPU 360 turns off the solenoid assigned to the path selector 15 in step S138. Consequently, all the structural parts are returned to their initial positions.

When the sheet to be remained is sensed, the CPU 360 confirms the staple discharge sensor 305 is turned on and the shift outlet sensor 303 is turned off, and then turns on the hook 52*a* so that the stack of sheets can be positioned.

When the sheet to be remained is not sensed, the CPU 360 confirms the staple discharge sensor 305 is turned on and the shift outlet sensor 303 is turned off, then turns on the knock roller 12 so that the stack of sheets can be positioned.

The above-described embodiments are illustrative, and numerous additional modifications and variations are possible in light of the above teachings. For example, elements and/or features of different illustrative and exemplary embodiments herein can be combined with each other and/or substituted for each other within the scope of this disclosure and appended claims. It is therefore to be understood that within the scope of the appended claims, the disclosure of this patent specification can be practiced otherwise than as specifically described herein.

What is claimed as new and desired to be secured by Letters Patent of the United States is:

1. A sheet finishing apparatus, comprising:

a conveying member configured to convey recording media;

a tray configured to receive the recording media conveyed by the conveying member, the tray comprising, a holding member configured to hold the recording media therein and to contact a first edge of the recording media such that the recording media is positioned, a rotatable moving member configured to contact the recording media such that the holding member abuts against the recording media, a discharging member configured to discharge the recording media stacked by the holding member, a protruding member mounted on the discharging member and configured to contact a second edge of the recording media such that the recording media is positioned; and a controller configured to cause the protruding member to position the recording media by contacting the second edge of the recording media at a time before the recording media falls on a rear fence of the holding member that is configured to receive the recording media and forcing the recording media downward to contact the rear fence.

2. The sheet finishing apparatus according to claim 1, wherein the protruding member is configured to move in a direction opposite to the travel direction of the recording media.

3. The sheet finishing apparatus according to claim 1, wherein the protruding member is configured to move in a direction opposite to a travel direction of the recording media after the first edge of the recording media passes through the conveying member to be discharged to the tray and before the recording media falls to the holding member.

4. The sheet finishing apparatus according to claim 1, wherein a standby position of the protruding member before moving in a direction opposite to the travel direction of the recording media is determined according to a size of the recording media to be conveyed to the tray.

5. The sheet finishing apparatus according to claim 4, wherein movement of the protruding member to the standby position between the discharge of the recording media and movement of the recording media in the direction opposite to the travel direction of the recording media is performed after a size of a first copy sheet of a next job is determined.

6. The sheet finishing apparatus according to claim 5, wherein the discharging member is moved in the direction opposite to the travel direction of the stacked recording media when the stacked recording media is positioned.

7. The sheet finishing apparatus according to claim 6, wherein, after the protruding member mounted on the discharging member is moved in the direction opposite to the travel direction of the recording media and the first edge of the recording media is abutted against the holding member, a movement position of the protruding member is determined based on whether there is a stack of sheets.

8. The sheet finishing apparatus according to claim 7, wherein, after the protruding member mounted on the discharge member is moved in the direction opposite to the travel direction of the recording media and the first edge of the recording media is abutted against the holding member, the movement position of the protruding member is determined based on a number of staplings performed on the recording media.

9. A sheet finishing apparatus, comprising:

means for conveying recording media; and means for receiving the recording media conveyed by the means for conveying, the means for receiving comprising, means for holding the recording media therein and contacting a first edge of the recording media such that the recording media is positioned, first means for contacting on the recording media such that the means for holding abuts against the recording media, means for discharging the recording media stacked by the means for holding, and second means for contacting a second edge of the recording media such that the recording media is positioned, the second means for contacting being mounted on the means for discharging; and means for controlling the second means for contacting to position the recording media by contacting the second edge of the recording media at a time before the recording media falls on a rear fence of the means for holding that receives the recording media and forcing the recording media downward to contact the rear fence.

10. The sheet finishing apparatus according to claim 9, wherein the second means for contacting is moved in a direction opposite to the travel direction of the recording media.

11. The sheet finishing apparatus according to claim 9, wherein the second means for contacting is moved in a direction opposite to a travel direction of the recording media after the first edge of the recording media passes through the means for conveying and before the recording media falls to the means for holding.

12. The sheet finishing apparatus according to claim 9, wherein a standby position of the second means for contacting before moving in a direction opposite to the travel direction of the recording media is determined according to a size of the recording media to be conveyed to the means for receiving.

13. The sheet finishing apparatus according to claim 12, wherein the movement of the second means for contacting to a standby position between the discharge of the recording media and the movement of the recording media in the direction opposite to the travel direction of the recording media is performed after a size of a first copy sheet of a next job is determined.

14. The sheet finishing apparatus according to claim 13, wherein the means for discharging is moved in the direction opposite to the travel direction of the recording media when the stacked recording media is positioned.

15. The sheet finishing apparatus according to claim 14, wherein, after the second means for contacting is moved in the direction opposite to the travel direction of the recording media and the first edge of the recording media is abutted against the means for holding, a position of the second means for contacting to move is determined based on whether there is a stack of sheets.

16. The sheet finishing apparatus according to claim 15, wherein, after the second means for contacting is moved in the direction opposite to the travel direction of the recording media and the first edge of the recording media is abutted against the means for holding, a position of the second means for contacting to move is determined based on a number of staplings performed to the recording media.

17. A method of positioning a stack of recording media, comprising:

receiving a signal indicating a size of the stack of recording media;

confirming information of the signal;

moving a protruding member to a standby position according to the size of the stack of recording media;

causing the protruding member to position the stack of recording media by contacting a leading edge of the stack of recording media at a time before the stack of recording media falls on a rear fence of the holding member that receives the stack of recording media and forcing the stack of recording media downward to contact the rear fence;

conveying the stack of recording media to the tray; and discharging the stack of recording media to an external tray.

18. The method according to claim 17, further comprising:

moving the protruding member in a direction opposite to a travel direction of the recording media after a first edge of the recording media passes through a conveying member to be discharged to the tray and before the recording media falls to a holding member.

19. An image forming apparatus, comprising:

an image bearing member configured to bear an image;

a transfer mechanism configured to transfer a recording medium having the image thereon; and a sheet finishing apparatus configured to perform a sheet finishing operation with respect to the recording medium, the sheet finishing apparatus comprising, a conveying member configured to convey recording media including the recording medium, a tray configured to receive the recording media conveyed by the conveying member, the tray comprising, a holding member configured to hold the recording media therein and to contact a first edge of the recording media such that the recording media is positioned, a rotatable moving member configured to contact the recording media such that the holding member abuts against the recording media, a discharging member configured to discharge the recording media stacked by the holding member, and a protruding member mounted on the discharging member and configured to contact a second edge of the recording media such that the recording media is positioned, wherein the sheet finishing apparatus also includes a controller configured to cause the protruding member to position the recording media by contacting the second edge of the recording media at a time before the recording media falls on a rear fence of the holding member that is configured to receive the recording media and forcing the recording media downward to contact the rear fence.

20. An image forming apparatus, comprising:

means for bearing an image;

means for transferring a recording medium having the image thereon; and a sheet finishing apparatus configured to perform a sheet finishing operation with respect to the recording medium, the sheet finishing apparatus comprising, means for conveying recording media including the recording medium, and means for receiving the recording media conveyed by the means for conveying, the means for receiving comprising, means for holding the recording media therein and for contacting a first edge of the recording media such that the recording media is positioned, first means for contacting the recording media such that the means for holding abuts against the recording media, means for discharging the recording media stacked by the means for holding, second means for contacting, mounted on the means for discharging, a second edge of the recording media such that the recording media is positioned, wherein the sheet finishing apparatus also includes means for causing the second means for contacting to position the recording media by contacting the second edge of the recording media at a time before the recording media falls on a rear fence of the means for holding that receives the recording media and forcing the recording media downward to contact the rear fence.

* * * * *